US007999171B1

(12) United States Patent
Hamilton

(10) Patent No.: US 7,999,171 B1
(45) Date of Patent: Aug. 16, 2011

(54) THREE PICKUP GUITAR SWITCHING SYSTEM WITH TWO OPTIONS

(76) Inventor: John W. Hamilton, Rock Hill, NY (US)

( * ) Notice: Subject to any disclaimer, the term of this patent is extended or adjusted under 35 U.S.C. 154(b) by 0 days.

(21) Appl. No.: 12/799,899

(22) Filed: May 3, 2010

(51) Int. Cl.
*G10H 3/14* (2006.01)

(52) U.S. Cl. ..... 84/727

(58) Field of Classification Search ..... 84/727
See application file for complete search history.

(56) References Cited

U.S. PATENT DOCUMENTS

| | | | | |
|---|---|---|---|---|
| 7,521,628 | B2 * | 4/2009 | Armstrong-Muntner | 84/737 |
| 7,838,758 | B2 * | 11/2010 | Van Ekstrom | 84/743 |
| 2008/0034950 | A1 * | 2/2008 | Ambrosino | 84/742 |

* cited by examiner

*Primary Examiner* — Jianchun Qin

(57) ABSTRACT

A guitar pickup switching system for an electric guitar consisting of three pickups (typically in the bridge, middle, and neck positions). It uses a simple on/off switch for mode control and has two possible user preference options. The first option uses a 5-position pickup selector switch, and allows for all seven possible pickup combinations: the bridge pickup alone, the middle pickup alone, the neck pickup alone, the bridge and middle pickups together (electrically in parallel), the middle and neck pickups together, the neck and bridge pickups together, and finally the bridge, middle, and neck pickups together (all 3 pickups together). The second option has electrical wiring identical to the first, but uses a simpler 3-position pickup selector switch instead of a 5-position switch. This option does not provide for the combination of all three pickups together, but all the other six possible pickup combinations are available.

9 Claims, 2 Drawing Sheets

THREE PICKUP GUITAR SWITCHING SYSTEM WITH TWO OPTIONS

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISC APPENDIX

Not applicable.

BACKGROUND OF THE INVENTION

This invention is particularly applicable to a Fender Stratocaster guitar, but it also pertains to any electric guitars (including bass guitars) which consist of three pickups: a bridge pickup, a middle pickup, and a neck pickup. These pickups are physically situated near and underneath the guitar strings (on a Stratocaster, the pickups are mounted to the underside of a pick-guard assembly which in turn is mounted to the guitar body). As such, the pickups get electrical signals induced into them by the vibrating guitar strings. It is desirable to be able to select the different pickups or combinations thereof to get various sounds from the guitar. These electrical signals are then amplified in other external equipment which comprises a sound system.

The factory design of the Fender Stratocaster is such that only five of the possible seven pickup combinations are available. Also, there is limited tone control associated with the bridge pickup (possible only when the bridge and middle pickups are together via the setting of the 5-position pickup selector switch). Hence, there is a need for an improved and simple switching arrangement which allows for all possible pickup combinations, along with simple master volume and tone controls.

This invention is more versatile than prior art because either a 5-position pickup selector switch or a simpler 3-position switch can be used.

This invention is more user friendly than prior art because the volume and tone controls are simpler and the switch functions between the two modes of operation are more symmetric and therefore easier to remember for the guitarist.

When installed into a Fender Stratocaster (and possibly other types of guitars with three pickups), this invention gives cost reductions because it requires fewer and simpler parts than prior art.

BRIEF SUMMARY OF THE INVENTION

The object of this invention is to provide simplicity of controls along with improved guitar function and versatility (two user preference options are available). It allows a guitarist to connect the output of the pickups in various combinations in the simplest manner possible: in electrical parallel with each other (if not in the "one at a time" pickup mode). This invention works equally well with either single coil or humbucker (pickups comprised of two coils) style pickups, or combinations of both.

This invention is capable of providing all seven of the possible pickup combinations which is an improvement over a Fender Stratocaster that provides only five of the seven combinations. The seven user selectable pickup combinations provided by this invention are: the bridge pickup alone, the middle pickup alone, the neck pickup alone, the bridge and middle pickups together (electrically in parallel), the middle and neck pickups together, the neck and bridge pickups together, and finally the bridge, middle, and neck pickups together (all three pickups together). The master tone control of this invention effects all possible pickup combinations which is an improvement over a Fender Stratocaster which has indirect tone control over the bridge pickup.

This invention is more versatile than prior art because it is has two user preference options. The electrical wiring is identical for both of the user preference options; only one component needs to be changed. The first user preference option uses a 5-position pickup selector switch which (in conjunction with the simple mode control on/off toggle switch) provides all seven of the possible pickup combinations. Note that instead of a toggle switch: a push-button, push-pull, rotary, rocker, or slide type of on/off switch can be used for mode control. The second user preference option uses a simpler 3-position switch to provide six of the seven possible pickup combinations and still outperforms a Fender Stratocaster design (which uses a 5-position switch). In prior art, it is not feasible to incorporate a 3-position switch because there is a loss of function in comparison to the factory design of a Fender Stratocaster. The simpler 3-position switch here may be a user preference for some, because it is easier to know the exact switch setting by either visually looking at the switch actuator, or by feel (in poor lighting conditions); by comparison with the 5-position switch. The earliest Fender Stratocasters used a 3-position switch, so some guitar "purists" might even prefer it for this reason.

This invention has an overall control scheme which includes one master volume control and one master tone control which is simpler than both the factory design of a Fender Stratocaster and other prior art. A factory-built Fender Stratocaster uses two tone controls. Other prior art uses two volume controls. As an option, this invention can be incorporated into the control scheme of a factory-built Fender Stratocaster which uses two tone potentiometers by replacing one of the original tone potentiometers with a combination tone potentiometer and on/off mode switch.

This invention has symmetry between the two modes of operation. The first user preference uses a 5-position pickup selector switch. The function of switch positions 2 and 4 is identical to each other (they provide all three pickups in parallel together), and remain the same for both of the positions of the mode control on/off toggle switch. When the mode control toggle switch is in the off (down) position, this gives "one at a time" pickup mode selection for positions 1, 3, and 5 of the 5-position switch. When the mode control toggle switch is in the on (up) position, this provides the two pickups in electrical parallel at a time mode for switch positions 1, 3, and 5 (hereafter, "two pickups in electrical parallel at a time" will be referred to simply as "two at a time"). Prior art does not have this symmetry across both modes. The second user preference option for this invention uses a 3-position switch to provide six pickup combinations (the pickup combination of all three pickups together is not available here because switch positions 2 and 4 do not exist with the 3-position switch). The pickup selection functions for switch positions 1, 3, and 5 are identical for both of the user preference options in this invention.

To implement the first user preference option of this invention into a Fender Stratocaster, only one component needs to be removed and replaced: the tone control potentiometer nearest the output jack needs to be removed and replaced by a simple SPST (single-pole single-throw) on/off toggle switch. Beyond this, the guitar then needs to be rewired in accordance with the electrical schematic of FIG. 2. Prior art requires three components to be removed (the volume control potentiometer, and the two tone control potentiometers). Again for prior art: five components then need to be installed: two volume control potentiometers, two capacitors, and finally a tone control potentiometer which also incorporates a push-pull mode control switch (with the guitar then subsequently rewired). Beyond the first user preference option of this invention, the second user preference option requires only the replacement of the 5-position switch with a simpler 3-position switch. Therefore, this invention is more cost-effective than prior art when installed into a Fender Stratocaster (and possibly other 3-pickup electric guitars).

DETAILED DESCRIPTION OF THE INVENTION

Figure 1:
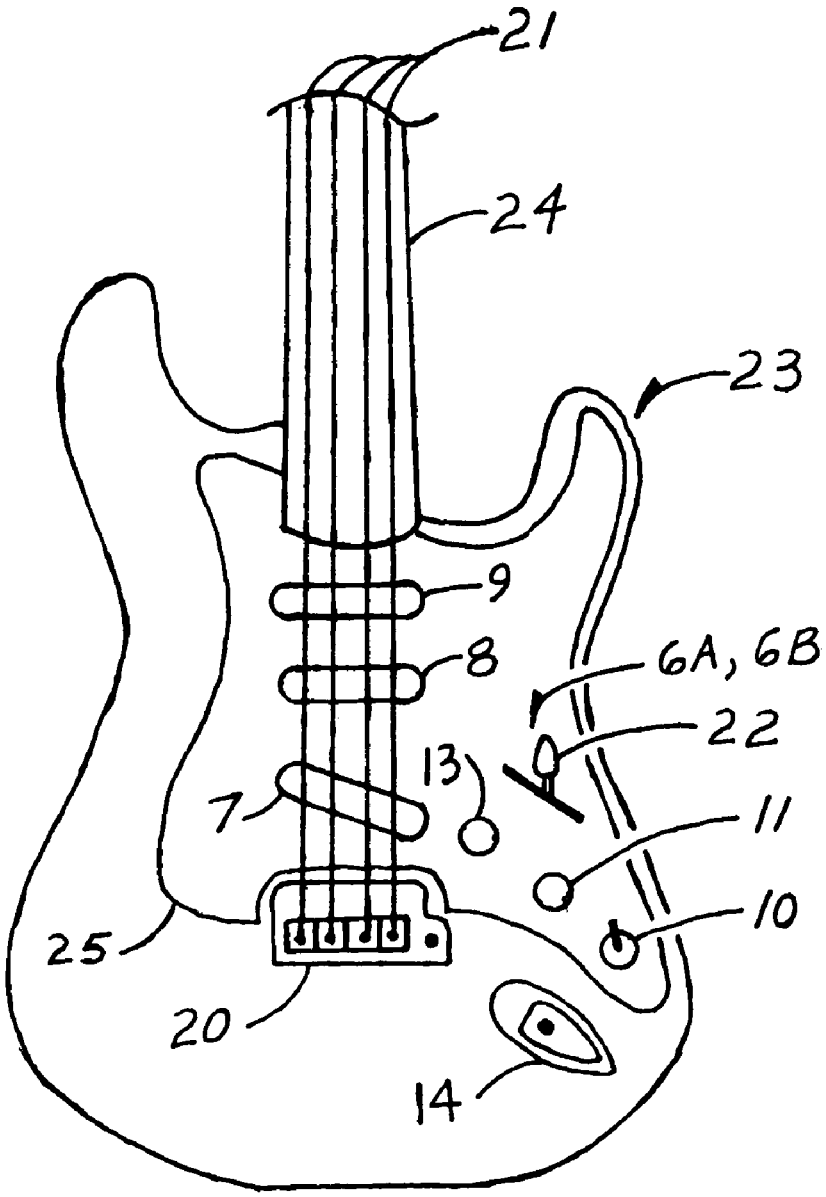
FIG. 1 is a simplified depiction of a Fender Stratocaster electric guitar with three pickups showing the control scheme resulting when this invention is installed.

This invention is applicable to any electric guitars (even bass guitars) which use three pickups (refer to FIG. 1). When implemented into a Fender Stratocaster, all electrical components of such a guitar 23 (with the exception of the output jack 14) are typically mounted to the pick-guard 25. For simplicity, the guitar 23 is depicted as having four strings 21, but these guitars typically have six strings. The strings 21 are secured at the upper end of the neck 24 by tuning keys (not shown here), and they are secured at their lower end by the bridge 20. All three pickups reside underneath the strings 21, and from bottom to top are: the bridge pickup 7, the middle pickup 8, and the neck pickup 9. The simplified controls consist of: the master volume control potentiometer 13, the master tone control potentiometer 11, the SPST (single-pole single-throw) on/off mode control toggle switch 10; and the two-pole 5-position pickup selector switch 6A and 6B used in the first user preference option (the second user preference option uses a 3-position pickup selector switch instead of the 5-position switch 6A and 6B).

Figure 2:
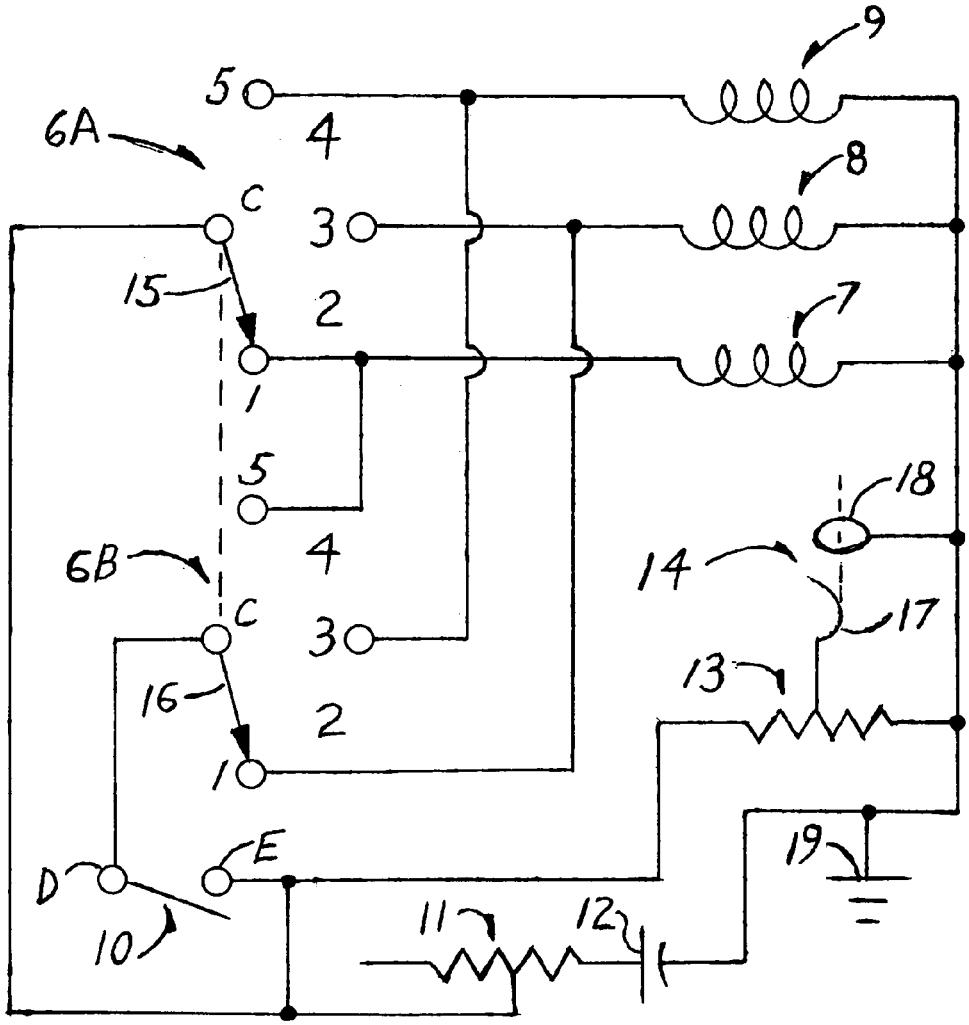
FIG. 2 is an electrical schematic showing details of one implementation of this invention.

Referring to the electrical schematic of FIG. 2, the 5-position pickup selector switch (installed in the first user preference option) is designated by the first pole 6A and the second pole 6B. The common terminal of each of these poles is designated as C. Depending upon the position of the user-controlled actuator 22 (FIG. 1) of this pickup selector switch, the common terminal C for each pole is electrically connected (hereafter "electrically connected" will be designated as simply "connected") by the contact arms 15 and 16 to each of the switch terminals 1, 3, and 5; one terminal at a time. Although the two poles are electrically isolated from one another, their contact arms 15 and 16 physically move together when rotated (i.e. they are in the same mutual position). Also note that positions 2 and 4 of each pole are not actual switch terminals. They simply denote the intermediate switch positions for each pole. When the switch is set to position 2, then the adjacent terminals 1 and 3 are connected together (internally by the switch) and also connected to the common terminal C for each pole (by contact arm 15 for the first pole and by contact arm 16 for the second pole). When the switch is set to position 4, then the adjacent terminals 3 and 5 are connected together (internally by the switch) and also connected to the common terminal C for each pole.

Unless otherwise specified, what follows for the rest of the detailed description refers to the electrical schematic of FIG. 2. The three pickups (the bridge pickup 7, the middle pickup 8, and the neck pickup 9) are for simplicity each shown as single-coils (pickups in general are more complicated and are comprised of other subcomponents). Note that one side of each of these pickups is electrically wired to ground potential 19 within the guitar 23 (FIG. 1). The connection to the amplifier equipment external to the guitar is accomplished via the output jack 14 (tip 17 and ring 18) and coax cable (not shown). The other side of each of these pickups is their output side and is wired to the first pole 6A of the 5-position pickup selector switch. What follows for the rest of this paragraph assumes that the guitar is set to "one at a time" mode (i.e. the on/off mode toggle switch 10 is in the off (down) position). The pickup wiring of the first pole 6A of the 5-position switch follows the same convention as found in a factory-built Fender. Stratocaster: the physical position of the user-controlled switch actuator 22 (FIG. 1) allows the guitarist to know which pickup is selected. The electrical schematic of FIG. 2 is drawn with the 5-position 6A and 6B switch set to position 1. This allows the output of the bridge pickup 7 which is wired to switch terminal 6A-1 to be connected through the contact arm 15 to the first pole common terminal 6A-C. If the 5-position switch is set to position 3, then the output of the middle pickup 8 which is wired to switch terminal 6A-3 becomes connected through the contact arm 15 to the first pole common terminal 6A-C. If the 5-position switch is set to position 5, then the output of the neck pickup 9 which is wired to switch terminal 6A-5 becomes connected through the contact arm 15 to the first pole common terminal 6A-C. Further wiring connects 6A-C to one side of the master volume potentiometer 13. The tip 17 of the output jack 14 of the guitar is also wired to potentiometer 13 to provide master volume adjustment of the output. Therefore, for each of the three positions 1, 3, or 5 of the 5-position switch 6A and 6B, with the on/off mode toggle switch 10 set to the off position (i.e. "one at a time" pickup mode selected), then respectively, the bridge pickup 7, the middle pickup 8, or the neck pickup 9 are each separately selected as the output of the guitar 23 (FIG. 1).

The output side of each of the three pickups is also wired to the second pole 6B of the 5-position switch. In detail: the bridge pickup 7 is wired to 6A-1 and also to 6B-5, the middle pickup 8 is wired to 6A-3 and also to 6B-1, and finally the neck pickup 9 is wired to 6A-5 and also 6B-3. The heart of this invention is that the pickup wiring scheme of the second pole 6B is offset with respect to that of the first pole 6A. This wiring offset allows for the guitar output to be two pickups at a time connected in electrical parallel with each other when the 5-position switch 6A and 6B is in positions 1, 3, or 5 and the on/off mode toggle switch 10 is in the on (up) position. In detail, with the 5-position switch 6A and 6B set to position 1, the common terminal 6A-C of the first pole is connected (through contact arm 15) to the output side of the bridge pickup 7. Simultaneously, the common terminal 6B-C of the second pole is connected (through contact arm 16) to the output side of the middle pickup 8. Terminal 6B-C is wired to the on/off toggle switch 10 terminal D. With this toggle switch 10 in the on position, its terminals D and E are connected to each other. This causes 6B-C to be connected to the same side of the master volume potentiometer 13 as is 6A-C.

The result is that the bridge pickup 7 and the middle pickup 8 are in parallel with each other (i.e. "two at a time" mode) and selected as the output of the guitar 23 (FIG. 1). The two other selectable outputs of the guitar 23 (FIG. 1) for "two at a time mode" (with the on/off mode toggle switch 10 in the on position) are: the 5-position switch 6A and 6B in position 3 gives the middle pickup 8 and the neck pickup 9 in parallel; and finally the 5-position switch 6A and 6B in position 5 gives neck pickup 9 and the bridge pickup 7 in parallel.

With the wiring of the second pole 6B being offset with respect to the first pole 6A, the result of the 5-position switch set to position 2 is that all three pickups are connected in parallel with each other and selected as the output of the guitar 23 (FIG. 1). In detail, terminals 6A-1 and 6A-3 are connected to each other (internally through this switch), and simultaneously terminals 6B-1 and 6B-3 are also connected to each other (internally through this switch). With 6A-1 wired to the bridge pickup 7 and 6A-3 wired to the middle pickup 8, these two pickups are connected internally through this switch in parallel with each other and also to the first pole common terminal 6A-C (through the contact arm 15). As previously stated, terminal 6A-C is wired to one side of the master volume control potentiometer 13. With terminal 6B-1 wired to the middle pickup 8 and 6B-3 wired to the neck pickup 9, the net result gives all three pickups in parallel with each other and selected as the output of the guitar. In a similar way, when the 5-position switch 6A and 6B is set to position 4, the result is same with all three pickups in parallel with each other and selected as the output of the guitar 23 (FIG. 1). The position of the on/off mode toggle switch 10 for either "one at a time" or "two at a time" pickup mode selection has no effect when the 5-position switch 6A and 6B is in either positions 2 or 4. See the switch function table below for all the possible switch combinations.

THREE PICKUP GUITAR SWITCHING SYSTEM FUNCTIONS

| 5-Position Switch 6A, 6B Settings | On/off Toggle Switch 10 = OFF (DOWN position = "one at a time" pickup mode) | On/off Toggle Switch 10 = ON (UP position = "two at a time" pickup mode) |
|---|---|---|
| 1 | Bridge pickup alone | Bridge and middle pickups in parallel |
| 2 | All 3 pickups in parallel | All 3 pickups in parallel |
| 3 | Middle pickup alone | Middle and neck pickups in parallel |
| 4 | All 3 pickups in parallel | All 3 pickups in parallel |
| 5 | Neck pickup alone | Neck and bridge pickups in parallel |

Note that one side of the tone control potentiometer 11 is wired to one side of the master volume potentiometer 13. The other side of the tone control potentiometer 11 is wired to the capacitor 12, with the other side of this capacitor in turn wired to ground potential 19. The overall result is a tone control in parallel with the output of the guitar 23 (FIG. 1), making it a master tone control.

The second user preference option uses a simpler 3-position pickup selector switch instead of the 5-position switch 6A and 6B. The electrical wiring for both of the user preference options is identical. For a Fender Stratocaster, the 3-position switch is a "drop-in" part which requires no guitar 23 (FIG. 1) modifications. This 3-position switch is the same type as used in the Fender Telecasters. Since the intermediate switch positions 2 and 4 do not exist for the 3-position switch, the pickup combination of three pickups together in parallel together does not exist. The function of the on/off mode toggle switch 10 is the same as for the first user preference option: switch 10 in the off (down) position gives "one at a time" pickup mode select ability via the 3-position switch; switch 10 in the on (up) position gives "two at a time" pickup mode select ability via the 3-position switch (for a total of six selectable pickup combinations).

As previously mentioned in the BRIEF SUMMARY OF THE INVENTION section, either a: push-button, push-pull, rotary, rocker, or slide type of switch can be used instead of the toggle type of switch for the on/off mode switch 10. As an option, this invention can be incorporated into the control scheme of a factory-built Fender Stratocaster which uses two tone potentiometers by instead of using a discrete on/off mode switch 10, one of the original tone potentiometers is replaced with a combination tone potentiometer and on/off mode switch. In addition to the wiring previously described, the original tone control potentiometer 11 would be wired to the neck pickup 9; and for the combination tone control potentiometer and on/off mode switch: the tone control potentiometer portion would be wired to the middle pickup 8, and the on/off mode switch portion would be wired exactly the same as the on/off mode toggle switch 10 previously described.

Changes can be made to the invention with respect to the physical embodiments set forth in the specification and drawings, without departing from the scope and spirit of the invention as set forth in the claims section.

The invention claimed is:

1. A three pickup guitar switching system comprising:
- a bridge pickup;
- a middle pickup;
- a neck pickup;
- a pickup output jack;
- a two-pole pickup selector switch: wherein for a first user preference option said pickup selector switch is a 5-position switch, wherein for a second user preference option said pickup selector switch is a 3-position switch;
  - a switch means via a wiring scheme identical for both user preference options whereby the pickup wiring of the second pole of the aforementioned pickup selector switch is offset with respect to the pickup wiring of the first pole of said switch with the common terminal of the second pole of the pickup selector switch electrically wired in series to one side of an on/off mode switch with the other side of said on/off mode switch wired to the common terminal of the first pole, with the common terminal of the first pole being wired to the master volume control potentiometer, with said on/off mode switch then allowing for the electrically parallel connection or disconnection of the common terminals of both poles of the pickup selector switch to provide for "one at a time" pickup or "two at a time" pickup mode select ability for both user preference options; and also for three pickups in electrical parallel select ability for the first user preference option.

2. A three pickup guitar switching system as defined in claim 1 further comprising a simplified control system containing:
- a single master volume control potentiometer;
- a single master tone control potentiometer;
- an aforementioned on/off mode switch is a discreet switch.

3. A three pickup guitar switching system as defined in claim 1 further comprising:
- a single master volume control potentiometer;
- a first tone control potentiometer wired to either the bridge pickup, the middle pickup, or the neck pickup;

a combination second tone control potentiometer and an aforementioned on/off mode switch: with the second tone control potentiometer portion wired to a pickup other than the said first tone control potentiometer.

4. A three pickup guitar switching system as defined in claim 2 or 3 wherein: said on/off mode switch is a toggle type switch.

5. A three pickup guitar switching system as defined in claim 2 or 3 wherein: said on/off mode switch is a push-button type switch.

6. A three pickup guitar switching system as defined in claim 2 or 3 wherein: said on/off mode switch is a push-pull type switch.

7. A three pickup guitar switching system as defined in claim 2 or 3 wherein: said on/off mode switch is a rotary type switch.

8. A three pickup guitar switching system as defined in claim 2 or 3 wherein: said on/off mode switch is a rocker type switch.

9. A three pickup guitar switching system as defined in claim 2 or 3 wherein: said on/off mode switch is a slide type switch.

* * * * *